United States Patent [19]

Wörwag

[11] Patent Number: 4,827,558

[45] Date of Patent: May 9, 1989

[54] VACUUM CONDUIT ARRANGEMENT FOR A CENTRAL DUST-COLLECTING SYSTEM

[75] Inventor: Peter Wörwag, Romanshorn, Switzerland

[73] Assignee: Düpro AG, Romanshorn, Switzerland

[21] Appl. No.: 8,550

[22] Filed: Jan. 29, 1987

[30] Foreign Application Priority Data

Jan. 31, 1986 [DE] Fed. Rep. of Germany ..... 3602927

[51] Int. Cl.[4] ..... A47L 5/38

[52] U.S. Cl. ..... 15/314; 52/290

[58] Field of Search ..... 15/314; 52/290, 287; 98/40.03, 40.04

[56] References Cited

U.S. PATENT DOCUMENTS

| | | | |
|---|---|---|---|
| 800,053 | 9/1905 | Ayres | 52/290 |
| 2,725,113 | 11/1955 | Fagyas | 15/314 |
| 3,291,927 | 12/1966 | Riley et al. | 15/314 |
| 3,831,334 | 8/1974 | Rutkowski et al. | 52/290 |
| 3,975,467 | 8/1976 | Beck | 52/290 |
| 4,428,085 | 1/1984 | Bateson | 4/662 |

FOREIGN PATENT DOCUMENTS

| | | | |
|---|---|---|---|
| 265661 | 6/1964 | Fed. Rep. of Germany | 52/290 |
| 1434220 | 10/1968 | Fed. Rep. of Germany | 52/290 |
| 1196663 | 7/1970 | United Kingdom | 52/290 |
| 2128223 | 4/1984 | United Kingdom | 52/287 |

*Primary Examiner*—Harvey C. Hornsby
*Assistant Examiner*—Corinne M. Reinckens
*Attorney, Agent, or Firm*—Becker & Becker, Inc.

[57] ABSTRACT

A vacuum conduit arrangement for use with a central dust-collecting system that is provided in a building. The arrangement includes vacuum conduits that are interconnected by couplings. The arrangement further includes at least one connector for a vacuum hose of a cleaning apparatus. The vacuum conduits are conduit-like floor or base moldings that are disposed in the corner zones between the floors and walls of the building. These moldings can be easily retrofitted in an exposed manner as a conduit system along the edges of the floors.

20 Claims, 6 Drawing Sheets

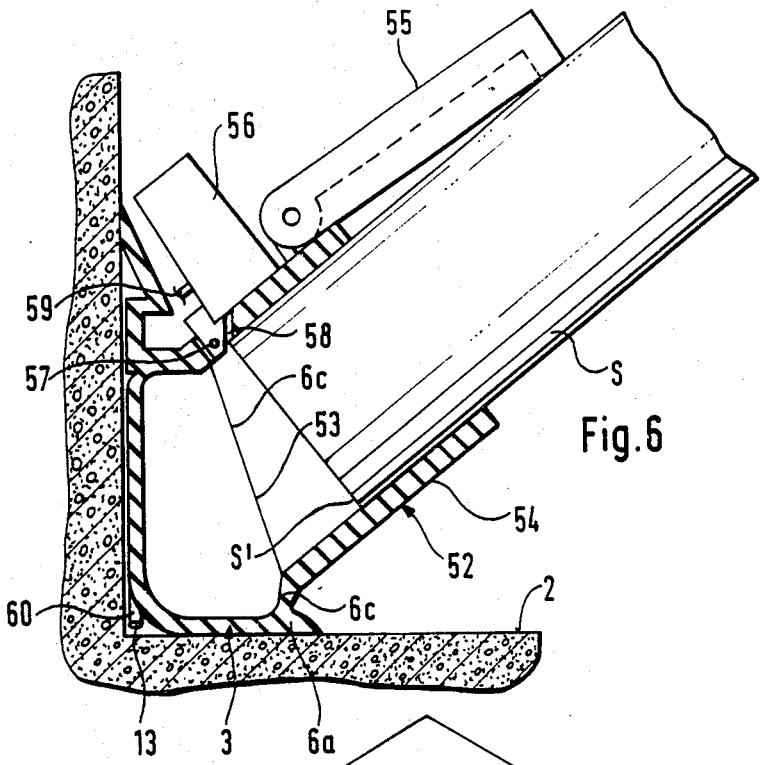
Fig.6
Fig.11
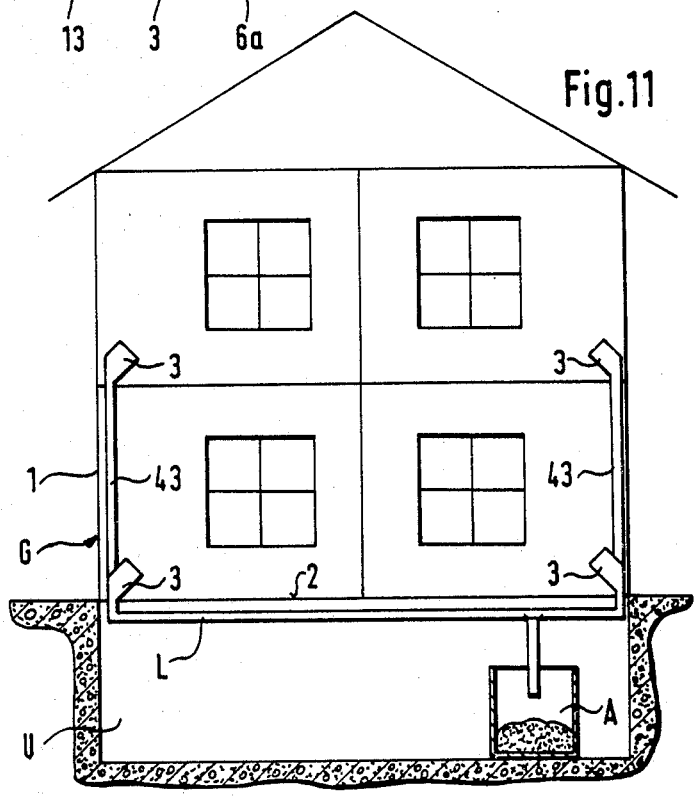

VACUUM CONDUIT ARRANGEMENT FOR A CENTRAL DUST-COLLECTING SYSTEM

BACKGROUND OF THE INVENTION

The present invention relates to a vacuum conduit arrangement for a central dust-collecting system that is provided in a building and has vacuum conduits that are interconnected by couplings. The system further has at least one connection means for a vacuum hose of a cleaning apparatus.

It is known to use vacuum cleaners for the dry-state cleaning of rooms and all types of objects, such as upholstered furniture, beds, drapes, carpets, etc., that are disposed in these rooms. With such apparatus, which are generally driven by an electric motor, a suction fan is driven with a motor that operates at high speed; this suction fan generates a strong suction stream. This suction stream is fed to the vacuum cleaner via a flexible vacuum hose. The free end of the vacuum hose is provided, via a suction pipe, with a suction mouthpiece, a so-called suction nozzle. During vacuuming, this suction nozzle glides over the surface that is to be cleaned, whereby the suction stream that flows into the suction nozzle at high velocity carries along the dirt and dust particles located in the vicinity of the suction nozzle. The stream of dust-laden air is conveyed to a filter device, which is preferably formed by a filter bag of filter-active material, such as textile fabric or paper. Due to the filtering action, the dirt contained in the stream of dust-laden air is retained and accumulated in the apparatus, with the "cleaned" stream of air being returned to the atmosphere of the room. However, all of these movable vacuum cleaners, which have a high suction capacity, have the drawback that the relatively heavy and cumbersome apparatus must be moved forward while proceeding with the vacuuming. With so-called hand-operated devices, the relatively heavy device must be moved with the hand over the surface that is to be cleaned. With devices having a vacuum hose, the device must be moved forward during vacuuming, and is laborious to transport, especially when cleaning steps, or when moving between rooms or between floors. With all of these devices, power is supplied via a long power cord, and the frequent need to change or replace the filter bag due to its small holding capacity is laborious and disruptive. Furthermore, due to the high output of the drive motor of these apparatus, a lot of noise is produced. Since the air that is returned to the room from these apparatus is never completely free of dust particles, an unpleasant odor results in conjunction with the air that was used as cooling air for the suction fan and hence was warmed up.

To avoid all of these drawbacks, central dust-collecting systems have been developed. With these systems, the suction fan and the filter mechanism are disposed in a separate room, generally in the basement of the building. A vacuum conduit arrangement, i.e. a pipe system, leads from the dust-collecting system to the rooms that are to be cleaned. In these rooms, depending on the size thereof, the pipe system is provided with one or more connectors for a vacuum hose to which are connected the vacuum pipe and the vacuum nozzle. The person who is vacuuming the room then has only to connect the vacuum hose to a connector of the pipe system via a simple-to-use coupling. A control device of the vacuum pipe arrangement turns the suction fan on. After the vacuuming process has been concluded, and after the vacuum hose has been detached from the system, the suction fan is again turned off by the control device. This dust-collecting system eliminates the objectionable power supply lines, and furthermore a room can be quickly and easily vacuumed without the heavy, unmanageable, and cumbersome to move apparatus, since it is only necessary to move the vacuum hose, with the vacuum pipe and suction nozzle, over the surface that is to be cleaned. Although the central dust-collecting systems constitute an expensive initial investment, may become amortized over a very short period of time, since costs for continuous overall, repair, and replacement of vacuum cleaners, as well as expensive throw-away filters, are eliminated. Furthermore, the annoying smell from the exhaust stream is eliminated since the exhaust is not returned to the room that is being cleaned, but rather is blown directly into the atmosphere. The big drawback of these central dust-collecting systems is that the required vacuum conduit arrangement must already be taken into account during planning and construction of the building, since for aesthetic reasons the conduit system must be placed in the masonry or the walls. This is expensive, and also produces a lot of dirt. In addition, when the furniture of a room is rearranged, a piece of furniture frequently ends up just where a connector for the vacuum hose is located. In this case, expensive chiselling in the masonry is necessary in order to move the connectors.

It is an object of the present invention to design a vacuum conduit arrangement of the aforementioned general type in such a way that the arrangement can be retrofitted in any finished building with little expense and without producing much dirt.

BRIEF DESCRIPTION OF THE DRAWINGS

This object, and other objects and advantages of the present invention, will appear more clearly from the following specification in conjunction with the accompanying schematic drawings, in which:

FIG. 6 is a cross-sectional view of the vacuum conduit of FIG. 1, and includes a connection adapter that is directed upwardly at an angle, and in which a vacuum hose is inserted;

FIG. 11 is a view that schematically illustrates the vacuum conduit arrangement of FIGS. 1 to 10 placed in a building.

SUMMARY OF THE INVENTION

Figure 1:
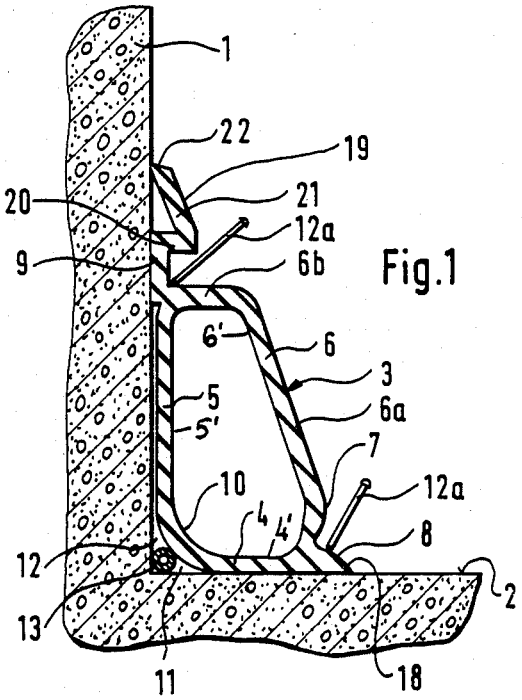
FIG. 1 is a cross-sectional view of one exemplary embodiment of a vacuum conduit of the inventive arrangement, with the vacuum conduit being in the form of a base molding.

The vacuum conduit arrangement of the present invention is characterized primarily in that the vacuum conduits are conduit-like floor or base moldings that can be disposed in corner zones between the floors and the walls of a building.

The inventive vacuum conduit arrangement comprises conduit-like floor or base moldings that, as a conduit system, are placed so that they are exposed along the edges of the floor. The vacuum conduits preferably have a trapezoidal or triangular cross-sectional shape, and fit inconspicuously and harmonically in the angle of intersection of the vertical building wall and the horizontal floor. The connectors for the cleaning apparatus, which comprises a vacuum hose having a suction pipe and a vacuum nozzle, are placed at the desired locations in a given vacuum conduit, and can easily be moved if necessary. It is also possible to extend a tie line from a vacuum conduit to a nonvisible location that is not in the way. If that region of a given vacuum conduit that extends into the corner between the wall of the building and the floor is rounded off, a channel is formed at this location. An electric control line of the central dust-collecting system can be accommodated in this channel. Securing strips can be provided at the outer surface of the vacuum conduit to accommodate nails or screws for securing the vacuum conduit to the wall of the building or to the floor. These securing strips can be embodied as a decorative covering, for example by having a strip of carpet placed thereon. The inventive vacuum conduit arrangement can be installed in new buildings, or can even be retrofitted in existing buildings, and it does not take an experienced person to install this arrangement. It is, however, occasionally necessary to bore a hole in a wall or ceiling.

Further specific features of the present invention will be described in detail subsequently.

DESCRIPTION OF PREFERRED EMBODIMENTS

Referring now to the drawings in detail, the vacuum conduit arrangement of FIGS. 1 to 11 comprises, depending upon need, of a more or less large number of vacuum pipes or conduits 3 that, as base moldings, are placed along the edges of a floor 2, and are interconnected by couplings. As shown in FIG. 11, the vacuum conduit arrangement is part of a central dust-collecting system that is preferably disposed in the basement U of a building G. This system includes a suction fan A that is activated when a suction pipe or a vacuum hose S or the like is connected to one of the vacuum conduits 3 (FIG. 6). The suction fan A communicates with the vacuum conduits 3 via lines L. The vacuum conduits 3 of the various stories or floors of the building are interconnected via vertically extending connection lines 43.

FIG. 1 shows one of the vacuum pipes or conduits 3, which in this case is embodied as a floor molding and is disposed in the corner region between a wall 1 of the building and the floor 2. This vacuum conduit 3 has a trapezoidal cross-sectional shape that is defined by an angular front wall 6 having an inner wall 6', a base part 4 having an inner wall 4', and a back wall 5 having an inner wall 5'; the back wall 5 extends at right angles to the base part 4. The back wall 5 is approximately twice as wide as the base part 4, and approximately the same width as the first wall portion 6*a* of the front wall 6. The wall portion 6*a* is connected to the base part 4 via a rounded-off longitudinal edge 7, and, in a similarly rounded-off manner, merges into an upper, second wall portion 6*b* of the front wall 6, with this second wall portion 6*b* extending parallel to the base part 4. The second wall portion 6*b* is narrower than the base part 4, so that the first wall portion 6*a* extends at a relatively small acute angle relative to the wall 1 of the building and to the floor 2. Connected to the base part 4 and to the back wall 5 are outwardly extending securing strips 8 and 9 that preferably extend over the entire length of the vacuum conduit 3. This vacuum conduit is secured to the floor 2 and the back wall 1 via the securing strips 8 and 9. In order to receive securing elements 12*a*, such as screws, nails, non-illustrated clamps, or the like, the securing strips 8, 9 can be provided with holes through which the securing elements 12*a* can be inserted. The securing strips 8, 9 form extensions of the base part 4 and of the back wall 5. The securing strip 9 projects slightly beyond the back wall 5, so that the latter is spaced slightly from the wall 1 of the building.

The vacuum conduit 3 can also be secured to the wall 1 and the floor 2 via an adhesive or an adhesive strip. This is particularly advantageous if the wall 1 and the floor 2 are made, for example, of concrete, so that it would be difficult to pound or otherwise force the securing elements 12*a* into the wall 1 and the floor 2.

In the installed state of the vacuum conduit 3, the lower, rearward longitudinal edge 10 thereof, which is rounded-off, is spaced from the adjacent corner zone 11 between the floor 2 and the wall 1 of the building. As a result, a channel 12 is formed at this location and extends along the edge of the floor. An electric control line 13 of the central dust-collecting system is accommodated in this channel 12.

Figure 10:
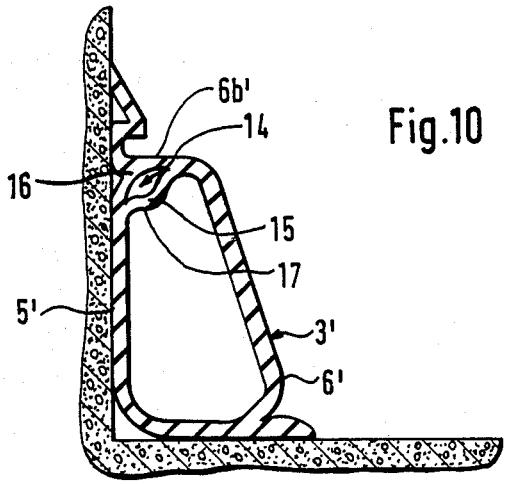
FIG. 10 is a cross-sectional view of a further exemplary embodiment of a vacuum conduit of the inventive vacuum conduit arrangement.

As shown in the further embodiment of a vacuum conduit 3' in FIG. 10, a channel 14 can also be provided within the vacuum conduit for accommodating the control line 13. This channel 14 is preferably provided in the upper corner region 15 between the back wall 5' and the adjoining second wall portion 6*b*'; the channel 14 is delimited by a partition 16. This partition 16 has a projection 17, which extends into the cross-sectional area of the conduit, and is integrally formed with the back wall 5' and the wall portion 6*b*'. When pneumatic control is used, the channel 14 can also serve directly as an air channel. In other respects, the vacuum conduit 3' corresponds to the vacuum conduit 3 of FIGS. 1 and 2.

Figure 2:
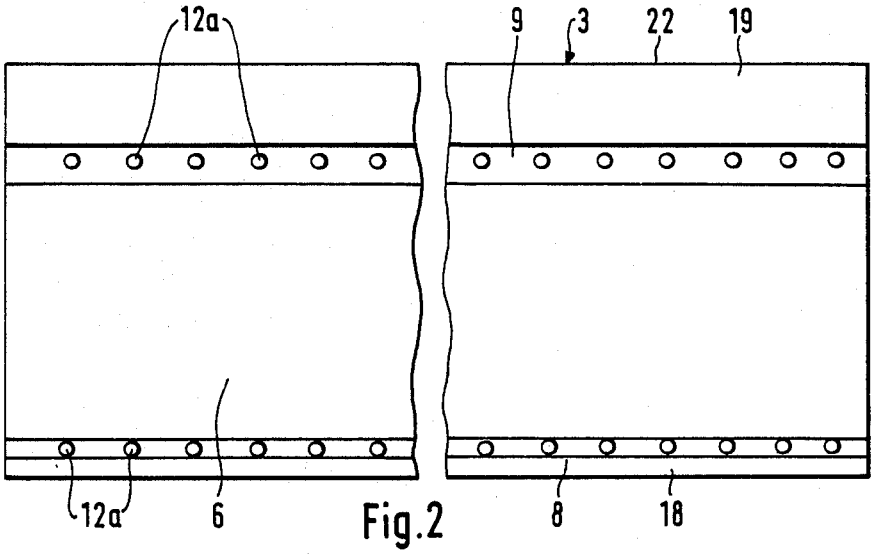
FIG. 2 is a view of one longitudinal side of the vacuum conduit of FIG. 1.

To provide a seal for the vacuum conduit 3, respective sealing means 18, 19 are provided on the securing strips 8, 9 (FIGS. 1, 2). The sealing means 18 of the securing strip 8 forms a sealing lip that is formed by an outwardly acutely angled, tapered edge portion of the securing strip.

The sealing means 19 is formed by a strip that has an angular cross-sectional shape, with a first leg 20 thereof being connected at right angles to the securing strip 9.

The second leg 21 of the sealing means 19 forms an acute angle with the first leg 20. To form a sealing lip, the edge 22 of the second leg 21 is tapered at an acute angle just like the sealing means 18, so that this edge 22 abuts the wall 1 of the building only in a linear manner. The second leg 21 and the sealing means 18 are approximately aligned with the wall portion 6a of the front wall 6, so that the vacuum conduit 3 has an essentially planar outer surface. The sealing means 18, 19 are advantageously made of a flexible material, and can be secured to the securing strips 8, 9, such as by being glued or vulcanized thereto. The sealing means 18, 19 rest against the wall 1 and the floor 2 in a yielding manner.

Figure 9:
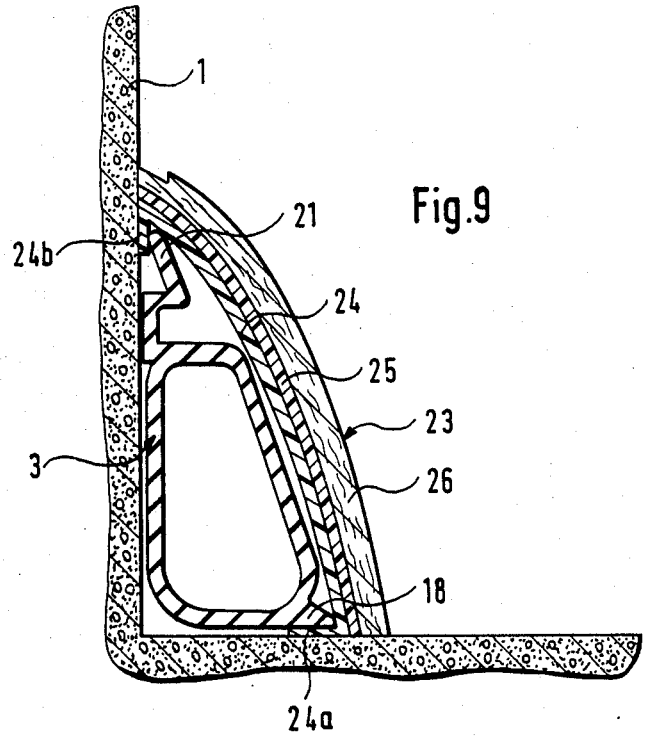
FIG. 9 is a cross-sectional view of the vacuum conduit of FIG. 1, and is provided with a decorative covering and a strip of carpet secured thereto.

As shown in FIG. 9, the front side of the vacuum conduit 3 can be provided with a covering 23 that is formed by a profiled strip. The latter can be made of a number of layers, such as a base layer 24, an intermediate layer 25, and a cover layer 26. The latter can, for example, be a decorative cover, for example with a wood-grained finish, can be wallpaper, or can even be a textile floor covering, so that the cover layer 26 can look the same as the wall covering of the wall 1 or the floor covering of the floor 2. It is also possible to have the cover layer 26 being formed by the textile floor covering, with the intermediate layer 25 being formed by a decorative, patterned, profiled element. Edge strips 24a, 24b of the base layer 24 extend around the securing strip or sealing means 18 and the free edge 22 of the second leg 21 of the securing strip or sealing means 19 respectively, thus assuring a reliable attachment of the covering 23.

Figure 3:
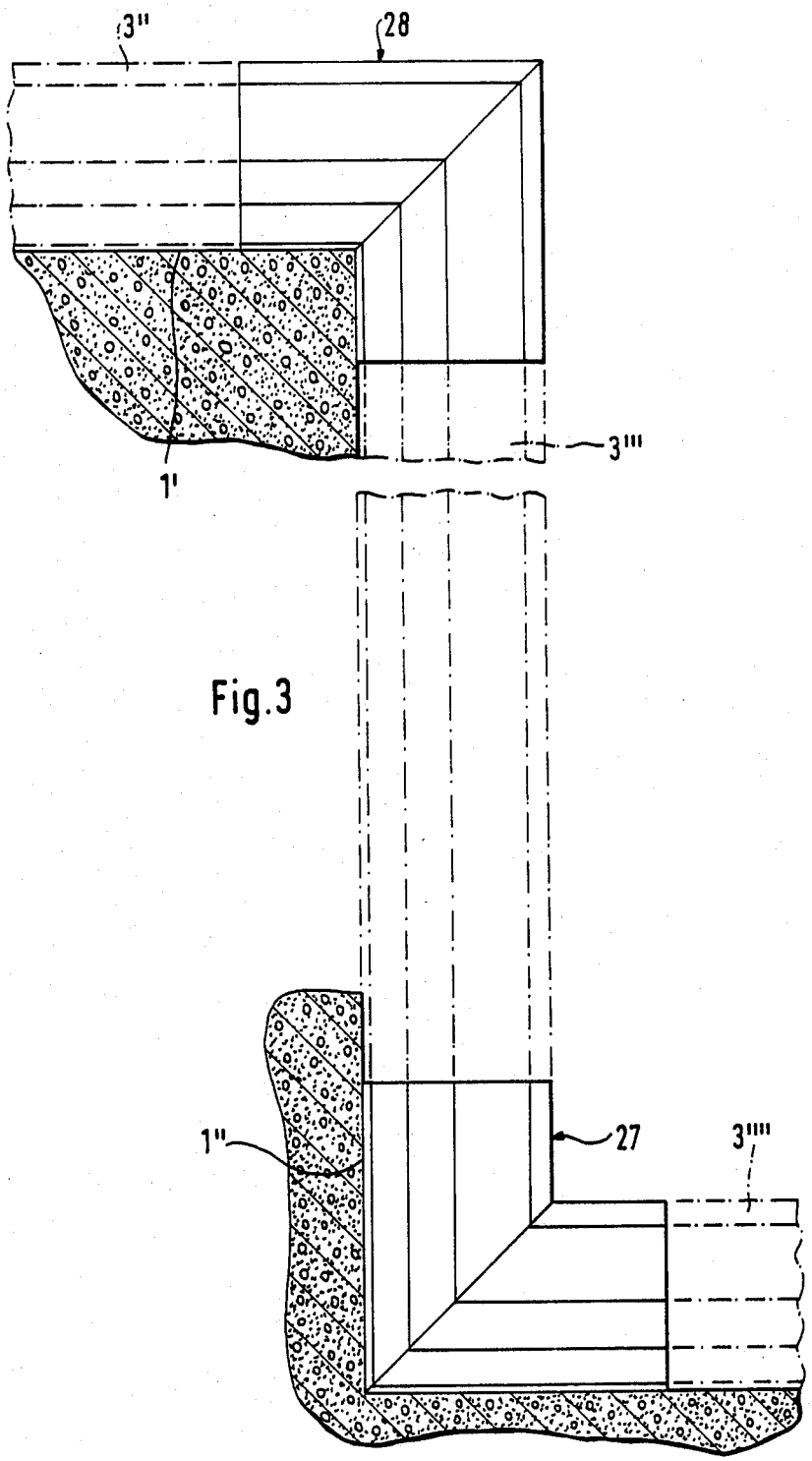
FIG. 3 is a view that shows an inventive vacuum conduit arrangement having three vacuum conduits that are placed around corners and are interconnected by couplings.

As shown in FIG. 3, to span inside and outside corners, couplings 27 and 28 are provided as inside and outside profiled parts. These couplings have the same cross-sectional shape as does the vacuum conduit 3, and connect three vacuum conduits 3'' to 3'''' that are placed along sidewalls 1' to 1'' that extend at right angles to one another; these three vacuum conduits are embodied in the same way as the vacuum conduit 3 of FIG. 1.

Figure 4:
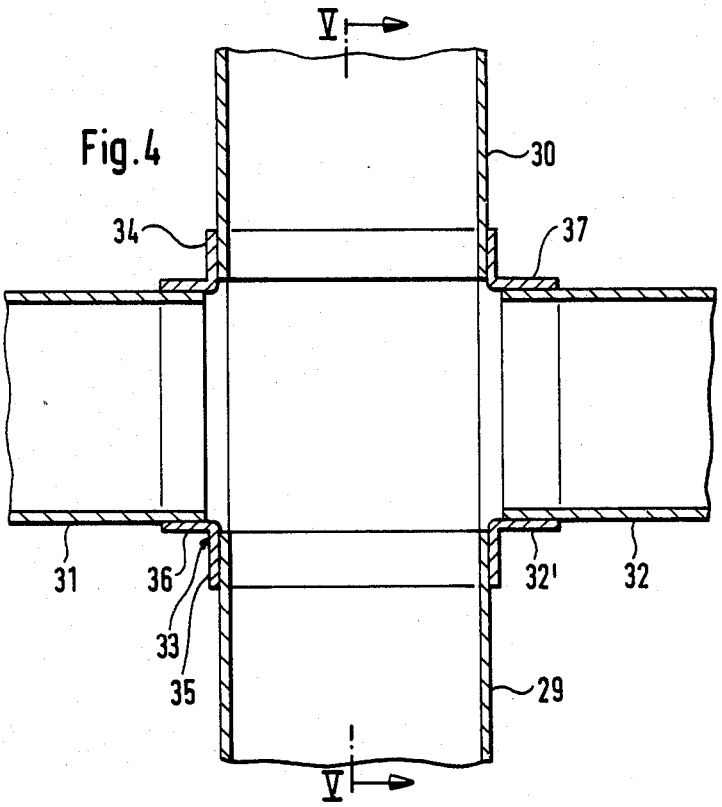
FIG. 4 is a view that shows a four-armed coupling of the inventive vacuum conduit arrangement, with this coupling having connected thereto, in the vertical direction, conduits having a rectangular cross-section, and in the horizontal direction, vacuum conduits.

As shown in FIG. 4, a four-armed coupling 33 is provided to connect two successive conduits 29, 30 that are disposed in a vertical plane and have a rectangular cross-sectional shape, and two successive vacuum conduits 31, 32 that are disposed in a horizontal plane. The coupling 33 has four arms 34 to 37 that are disposed in a radial manner. The arms 34, 35 serve to receive the conduits 29 and 30, whereas the other arms 36, 37 are provided to receive the vacuum conduits 31 and 32.

The arms 34, 35 have the same rectangular cross-sectional shape as do the conduits 29 and 30, whereas the arms 36, 37 have the same cross-sectional shape as do the vacuum conduits 31 and 32.

Figure 5:
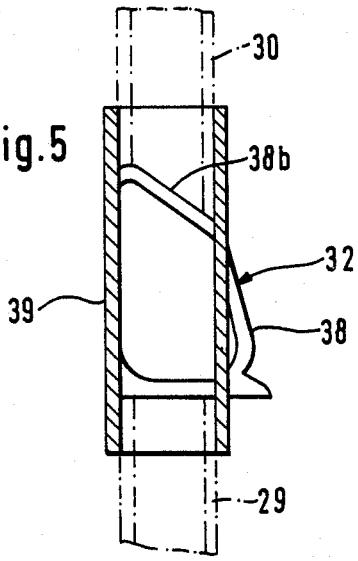
FIG. 5 is a cross-sectional view taken along the line V—V in FIG. 4.

The cross-sectional shape of the vacuum conduits 31, 32 and of the arms 36, 37 is illustrated in FIG. 5. This shape corresponds essentially to the cross-sectional shape of the vacuum conduit 3 of FIG. 1, with the difference that the second wall portion 38b of the front wall 38 extends at an acute angle relative to the back wall 39 in order to facilitate insertion of the vacuum conduit into the arms.

Figure 7:
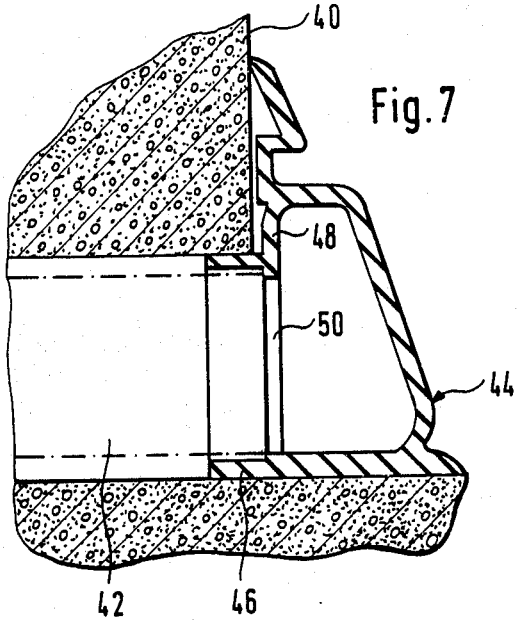
FIG. 7 is a cross-sectional view of the vacuum conduit of FIG. 1, and includes a connector part for connecting the vacuum conduit to a horizontally extending suction pipe that has a circular cross-section.
Figure 8:
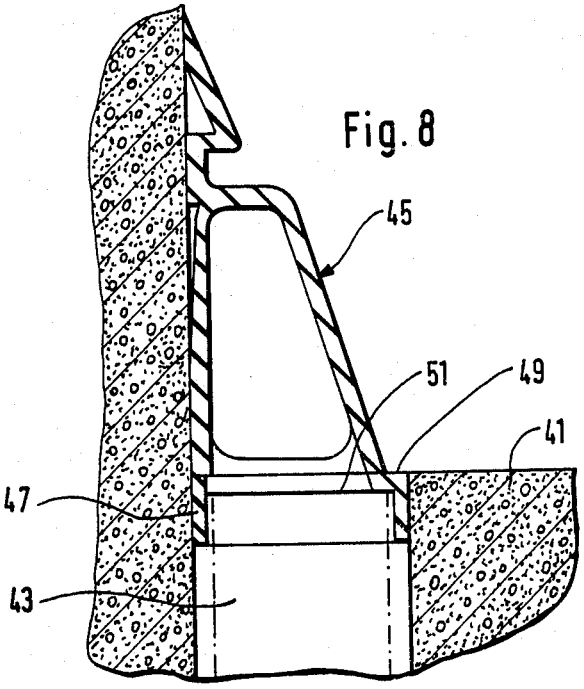
FIG. 8 is a cross-sectional view of the vacuum conduit of FIG. 1, and has a connector part for connecting the vacuum conduit to a vertically extending suction pipe that has a circular cross-section.

As shown in FIGS. 7 and 8, to pass through dividing walls 40 and ceilings 41 of the building G, conduits 42, 43 having a circular cross-sectional shape are advantageously used, with the pertaining openings in the walls being produced in a simple manner with drills. To connect to the conduits 42, 43, vacuum conduits 44, 45 having connector parts 46, 47 in the form of plug adapters are used.

The vacuum conduits 44, 45 have the same basic profile as does the vacuum conduit 3 of FIG. 1. The only difference is that the back wall 48 or the base part 49 is provided with an opening 50 or 51, on the edge of which the connector part 46 or 47 is formed that extends beyond the pertaining back wall or base part. The outer diameter of the connector part 46 is preferably somewhat greater than half the width of the back wall 48, whereas the outer diameter of the connector part 47 is approximately the same as the width of the base part 49. The vacuum conduits 44, 45 are inserted into the openings in the wall 40 or the ceiling 41 via these plug adapters.

As illustrated in FIG. 6, to effect connection of the vacuum hose S, the vacuum conduit is provided with at least one connection adapter 52, into which one end S' of the vacuum hose S can be inserted. The connection adapter 52 is advantageously integrally formed with the vacuum conduit 3. The connection adapter 52 extends beyond the first wall portion 6a of the front wall 6 of the vacuum conduit 3, and connects to the edge 6c of an opening 53 of the front wall 6. The center line of the connection adapter 52 extends at nearly right angles to the plane of the first wall portion 6a. When not being used, the connection adapter 52 can be closed off by a cover 55 that is pivotably mounted on the free end 54 of the adapter. A switch 56 is disposed near the connection adapter 52 in the region where the vacuum hose S is inserted. This switch 56 is connected to the control line 13 via connecting lines 59 and 60. When the vacuum hose S is inserted into the connection adapter 52, the switch 56 is actuated by a tripping pin 57 that is disposed in the path of movement of the vacuum hose S when the connection adapter 52 is in a non-operative position, i.e., when the vacuum hose S is not inserted. When the vacuum hose S is inserted, the tripping pin 57 is pressed upwardly into an associated support opening 58, thereby actuating the switch 56, as a result of which the suction fan A is turned on via the control line 13. When a vacuum hose S is withdrawn, the switch 56 is released by the tripping pin 57, so that the suction fan A is automatically turned off via the control line 13.

It would also be possible to control the central dust-collecting system via a known, remotely controlled device. Such a device could also incorporate a desired change in the suction power via a change of the speed of the fan motor. The suction power could also be altered mechanically by altering the amount to which a secondary air opening located on the vacuum hose is opened or closed.

The present invention is, of course, in no way restricted to the specific disclosure of the specification and drawings, but also encompasses any modifications within the scope of the appended claims.

What I claim is:

1. In a vacuum conduit arrangement for a central dust-collecting system that is provided in a building, said arrangement including couplings as well as vacuum conduits that are interconnected by said couplings, and further including at least one connection means for a vacuum hose of a cleaning apparatus, the improvement therewith comprising that:

said vacuum conduits consist of conduit-like base moldings for disposition in corner zones between floors and adjacent walls of said building having the dust-collecting system, solely said base moldings themselves being a vacuum conduit that can be installed originally as well as retrofitted in said building operatively joined with the vacuum hose for the vacuum conduit arrangement of the central dust-collecting system, said base moldings themselves forming a predetermined unitary hollow wall configuration that forms an airtight channel through which dust-laden and contaminated air is displaced via a cross section greater in vertical direction along the building floor substantially at right angles to each other with the wall configuration including an angular upwardly extending interconnection complementing the unitary hollow wall configuration that forms a flow-advantageous rounded interior at least in corner junctures thereof to avoid catching and holding dust-laden contaminated air; and securing means provided to fasten said base moldings to the building wall and building floor respectively, said securing means thereby holding the channel together in a stable structural unit.

2. A vacuum conduit arrangement according to claim 1, in which each of said vacuum conduits has an approximately trapezoidal cross-sectional shape, including: a base part for disposition adjacent a floor, with said base part having first and second longitudinal edges; a back wall for disposition adjacent a wall, with said back wall extending approximately at a right angle to said base part, and having first and second longitudinal edges, with said first longitudinal edges of said base part and of said back wall being interconnected; and an angular front wall that is disposed between said second longitudinal edges of said base part and of said back wall to interconnect same.

3. A vacuum conduit arrangement according to claim 2, in which each of said vacuum conduits is provided with at least one securing member to secure said vacuum conduits to at least one of said floors and said walls.

4. A vacuum conduit arrangement according to claim 3, in which at least one securing member of a given vacuum conduit is provided with sealing means that extends over the entire length of said vacuum conduit.

5. A vacuum conduit arrangement according to claim 4, in which one of said sealing means has an angular cross-sectional shape, including a leg for disposition at an angle against a wall of said building.

6. A vacuum conduit arrangement according to claim 5, in which said angular sealing means is associated with said back wall, with said angled leg of said angular sealing means being approximately in line with said front wall.

7. A vacuum conduit arrangement according to claim 4, in which, when said vacuum conduits are installed, said front wall extends at an acute angle to said walls and floors.

8. A vacuum conduit arrangement according to claim 4, in which said angular front wall includes a wall portion that adjoins said back wall and extends approximately parallel to said base part.

9. A vacuum conduit arrangement according to claim 4, in which said base part, said back wall, and said front wall merge into one another via rounded-off portions.

10. A vacuum conduit arrangement according to claim 4, in which one of said securing members is connected to said base part and has an outwardly tapered part that is remote from the latter and forms said sealing means.

11. A vacuum conduit arrangement according to claim 4, in which said front wall is provided with at least one opening, the latter having an edge that is provided with a connection adapter for a vacuum hose.

12. A vacuum conduit arrangement according to claim 11, in which one of said base part and said back wall of said vacuum conduit is provided with at least one further opening, the latter having an edge that is provided with a connector part, for insertion in a conduit disposed in a floor or wall.

13. A vacuum conduit arrangement according to claim 12, in which said connector part is integral with said vacuum conduit.

14. A vacuum conduit arrangement according to claim 12, in which the outer diameter of a connector part of a base part is approximately equal to the width of the latter, and the outer diameter of a connector part of a back wall is greater than half the width of the latter.

15. A vacuum conduit arrangement according to claim 4, in which each of said couplings is an angular element having the same cross-sectional shape as said vacuum conduits.

16. A vacuum conduit arrangement according to claim 4, which includes a coupling having a rectangular cross-sectional shape and four connection arms.

17. A vacuum conduit arrangement according to claim 4, in which said vacuum conduit is provided with a covering having an outer surface that faces the interior of a room and is provided with a cover layer.

18. A vacuum conduit arrangement according to claim 17, in which said covering comprises several layers, including a base layer that has edge strips that extend around ones of said sealing means that are associated with said back wall and said base part.

19. A vacuum conduit arrangement according to claim 4, in which the interior of said vacuum conduit is provided with channel means for an electric control line.

20. A vacuum conduit arrangement according to claim 19, in which, when a vacuum conduit is installed, a channel is formed in a corner zone between a floor and the adjoining wall.

* * * * *